US008281950B2

(12) United States Patent
Potts et al.

(10) Patent No.: US 8,281,950 B2
(45) Date of Patent: Oct. 9, 2012

(54) VERSATILE MULTI-COMPARTMENT BEVERAGE CONTAINER CARRIER

(75) Inventors: Kenneth Lee Potts, Solana Beach, CA (US); Debra Lee Potts, Solana Beach, CA (US)

(73) Assignee: Profound Products, Inc., Solana Beach, CA (US)

( * ) Notice: Subject to any disclaimer, the term of this patent is extended or adjusted under 35 U.S.C. 154(b) by 275 days.

(21) Appl. No.: 12/691,164

(22) Filed: Jan. 21, 2010

(65) Prior Publication Data

US 2011/0174824 A1 Jul. 21, 2011

(51) Int. Cl.
*B65D 25/06* (2006.01)

(52) U.S. Cl. ..... 220/531

(58) Field of Classification Search ..... 220/531, 220/530, 529, 528, 500, 915.2, 915.1, 592.26, 220/592.2, 551, 552; 62/457.7, 457.1; 160/152, 160/136, 137, 129, 128; D9/737; D3/202, D3/303, 283, 276, 310, 307, 319; 383/39; 190/126, 124; *B65D 25/08, 25/06, 25/04*
See application file for complete search history.

(56) References Cited

U.S. PATENT DOCUMENTS

| | | | | |
|---|---|---|---|---|
| 1,983,418 | A | 12/1934 | Thurmer | |
| 2,473,429 | A * | 6/1949 | Hinman | 206/162 |
| 2,665,801 | A * | 1/1954 | Berkman | 206/578 |
| 3,491,909 | A * | 1/1970 | Ikelheimer | 217/7 |
| 4,210,186 | A * | 7/1980 | Belenson | 206/316.2 |
| 4,260,004 | A | 4/1981 | Domke | |
| 5,046,860 | A | 9/1991 | Brennan | |
| 5,181,612 | A * | 1/1993 | Liu | 206/546 |
| 5,207,254 | A | 5/1993 | Fromm | |
| 5,356,004 | A | 10/1994 | Weinreb | |
| 5,421,172 | A | 6/1995 | Jones | |
| 5,769,221 | A * | 6/1998 | Cyr | 206/316.1 |
| 5,833,114 | A * | 11/1998 | Linnell | 220/531 |
| 5,842,571 | A | 12/1998 | Rausch | |
| 5,860,525 | A | 1/1999 | Bellehchili | |
| 6,186,201 | B1 | 2/2001 | Salz | |
| D587,897 | S | 3/2009 | Radke | |
| 2004/0149600 | A1 | 8/2004 | Wolter | |
| 2005/0051444 | A1 * | 3/2005 | Hurt et al. | 206/315.11 |
| 2006/0102497 | A1 * | 5/2006 | Wulf | 206/145 |
| 2008/0135142 | A1 | 6/2008 | Ellis | |
| 2008/0237068 | A1 | 10/2008 | Melamed | |

OTHER PUBLICATIONS

Lowel Soft Cases (Non-Patent Literature, http://www.lowel.com/cases_multi.html, Wayback Machine, Dec. 7, 2004, pp. 1-2).*
UnbeatableSale.com, Picnic Time 660-00-179 Cellar 6-Bottle insulated Wine tote with interchangeable liner, http://www.unbeatablesale.com/pt485.html.

* cited by examiner

*Primary Examiner* — Jacob K Ackun
*Assistant Examiner* — Robert J Hicks
(74) *Attorney, Agent, or Firm* — John L. Rogitz

(57) ABSTRACT

A beverage container carrier includes a parallelepiped-shaped insulated body with an internal space that can be variously configured by orienting internal panels, some of which are sewn along one side to the body, to form rectangular spaces for holding respective containers. Two panels can be held together along respective internal edges using Velcro™, with the panels cooperating structurally to provide their own support.

17 Claims, 4 Drawing Sheets

Figure 1
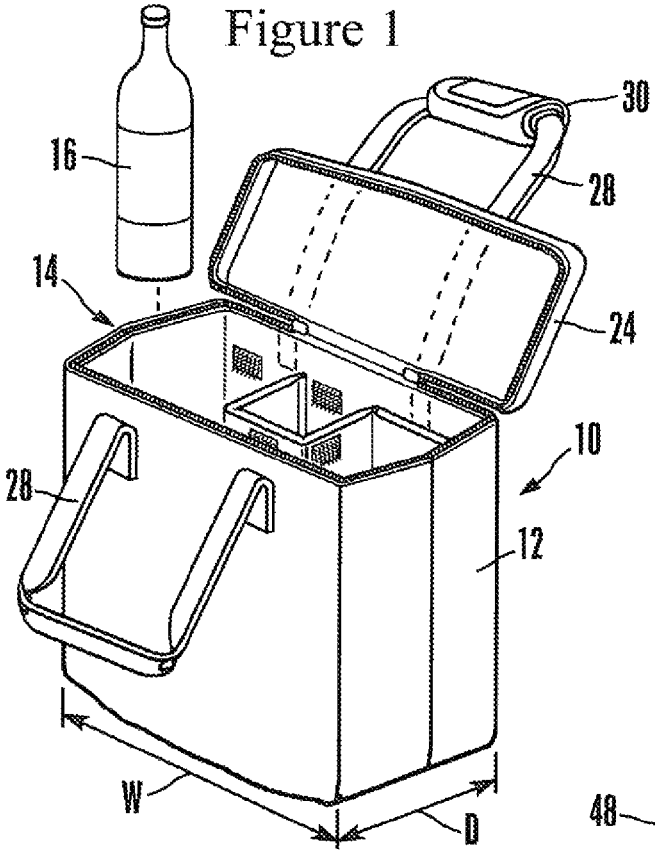
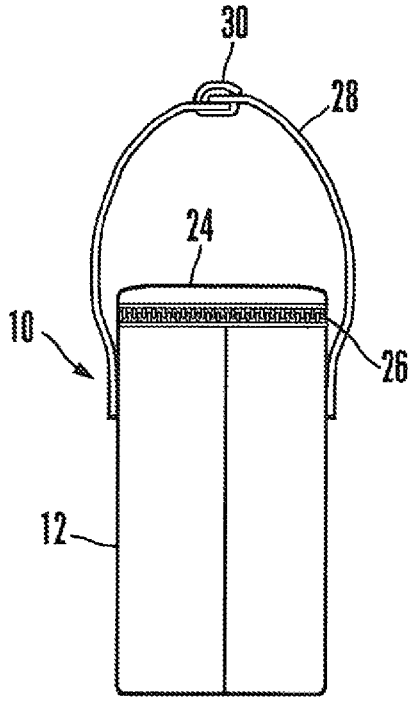
Figure 2
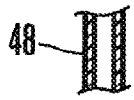
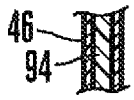
Figure 3 Figure 4 Figure 5
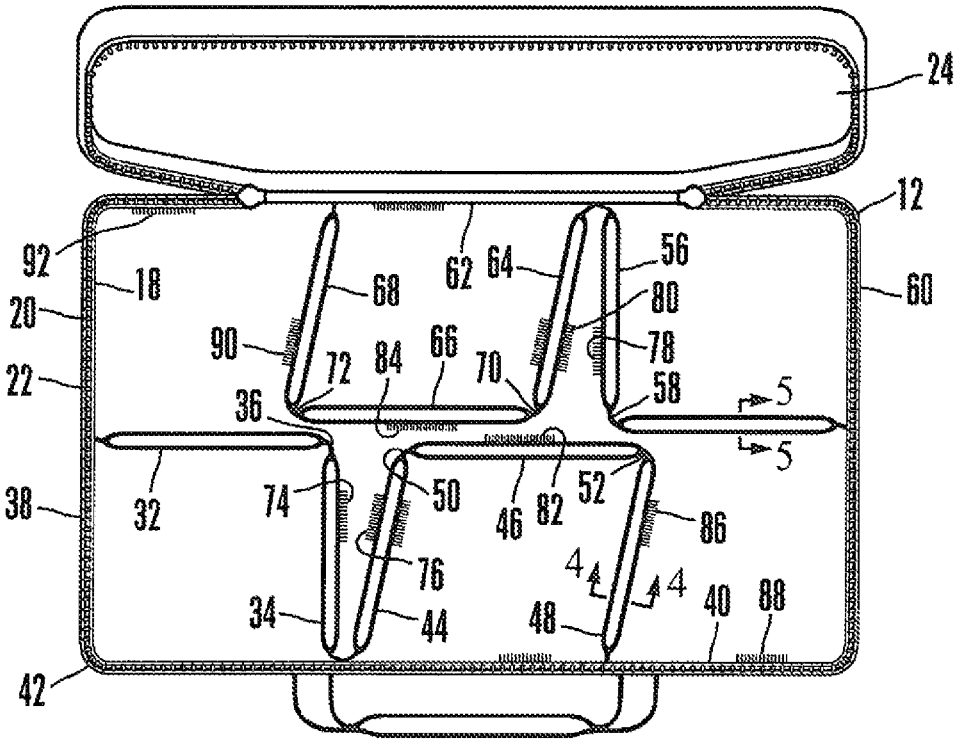

VERSATILE MULTI-COMPARTMENT BEVERAGE CONTAINER CARRIER

FIELD OF THE INVENTION

The present invention relates generally to multi-use carriers that can be used to transport beverage containers and food.

BACKGROUND OF THE INVENTION

It is often desired to transport multiple beverage containers such as wine bottles using a reusable and easy to carry holder. By being reusable, cardboard containers and other temporary containers are avoided, and, thus, waste generation is reduced.

As understood herein, a person may wish to carry different numbers of containers at different times while at the same time ensuring that the containers do not contact each other during transport. As also understood herein, since beverage containers typically hold cold or hot beverages, it would be desirable to provide insulation capability in a carrier. Furthermore, present principles understand that a person may wish to carry only a single container or multiple containers but in any case would like to do so with a single carrier that provides secure stowage regardless of how many items are carried. As also understood herein, such a carrier advantageously could be used to carry non-beverage foodstuffs such as bread, milk, etc. that is also afforded secure stowage and protection from other items being toted.

SUMMARY OF THE INVENTION

A beverage container carrier includes a parallelepiped-shaped insulated body with an internal space which is variously configurable by orienting internal panels, some of which are sewn along one side to the body, to form rectangular spaces for holding respective containers. At least two panels are detachably held together along respective internal edges using a hook-and-eye fastener with the panels cooperating structurally to provide their own support.

In another aspect, a beverage container carrier includes a parallelepiped-shaped insulated body defining an internal space. Plural panels are in the space. Each panel is movable along an edge thereof and at least some panels are sewn to the body along respective edges about what which the respective panels can pivot from a large configuration, in which all panels are substantially flat against an adjacent side of the body or against another panel that is flat against an adjacent side of the body, to a compartmentalized configuration, wherein two panels in cooperation with a side of the body establish a respective rectangular space configured for holding a respective container. Two panels can be held together along respective internal edges using a hook and eye fastening structure, with the panels cooperating structurally to provide their own support.

In another aspect, a carrier has a parallelepiped-shaped body defining an internal space. A first panel assembly in the space includes first and second panels joined together along respective edges to establish a first panel hinge. The first panel is attached to, as by sewing, the body along a first wall of the body and the second panel is attached to the body along a second wall of the body orthogonal to the first wall. With this structure the first panel assembly can be moved between a collapsed configuration, in which the first panel is substantially flush against the first wall, the second panel is substantially flush against the second wall, and the first panel hinge is closely juxtaposed with a first corner of the body established between the first and second walls, and an extended configuration, in which the first panel is substantially orthogonal to the first wall, the second panel is substantially orthogonal to the second wall, and the first panel hinge is distanced from the first corner to establish a first generally parallelepiped-shaped sub-enclosure.

A second panel assembly is also in the space. The second panel assembly includes third, fourth, and fifth panels, with the third and fourth panels being joined together along respective edges to establish a second panel hinge, the fourth and fifth panels being joined together along respective edges to establish a third panel hinge, and the third and fifth panels being attached to the body along the second wall of the body. The second panel assembly can be moved between a collapsed configuration, in which the panels of the second panel assembly are substantially flush against the second wall, and an extended configuration, in which the third and fifth panels are substantially orthogonal to the second wall and the fourth panel is substantially parallel to and spaced from the second wall to establish a second generally parallelepiped-shaped sub-enclosure.

Furthermore, a third panel assembly can be in the space. The third panel assembly can include sixth and seventh panels joined together along respective edges to establish a fourth panel hinge. The sixth panel is attached to the body along a third wall of the body and the seventh panel is attached to the body along a fourth wall of the body orthogonal to the third wall. The third panel assembly is movable between a collapsed configuration, in which the sixth panel is substantially flush against the third wall, the seventh panel is substantially flush against the fourth wall, and the fourth panel hinge is closely juxtaposed with a corner of the body, and an extended configuration, in which the sixth panel is substantially orthogonal to the third wall and the seventh panel is substantially orthogonal to the fourth wall to establish a third generally parallelepiped-shaped sub-enclosure.

Still further, a fourth panel assembly may be in the space and may include eighth, ninth, and tenth panels. The eighth and ninth panels are joined together along respective edges to establish a fifth panel hinge, while the ninth and tenth panels are joined together along respective edges to establish a sixth panel hinge. The eighth and tenth panels are attached to the body along a fourth wall of the body. The fourth panel assembly is movable between a collapsed configuration, in which the panels of the fourth panel assembly are substantially flush against the fourth wall, and an extended configuration, in which the eighth and tenth panels are substantially orthogonal to the fourth wall and the ninth panel is substantially parallel to and spaced from the fourth wall to establish a fourth generally parallelepiped-shaped sub-enclosure.

As set forth further below, a first hook and eye fastening member can be disposed to hold the second and third panels together when the first and second panel assemblies are in the extended configurations. As well, a second hook and eye fastening member may be disposed to hold the seventh and eighth panels together when the third and fourth panel assemblies are in the extended configurations. A third hook and eye fastening member can be disposed to hold the ninth and fourth panels together when the second and fourth panel assemblies are in the extended configurations.

In example non-limiting embodiments, a fourth hook and eye fastening member is disposed to hold the fifth panel and second wall together when the second panel assembly is in the collapsed configuration. Similarly, a fifth hook and eye fastening member can be disposed to hold the tenth panel and fourth wall together when the fourth panel assembly is in the collapsed configuration.

A beverage container can be in one of the sub-enclosures. Also, a top member can be hingedly attached to the body to removably cover the internal space. A handle member may also be attached to the body and configured for grasping by a person. In some embodiments at least one panel is reinforced with an internal filler pad and at least one panel is not reinforced with an internal filler pad.

BRIEF DESCRIPTION OF THE DRAWINGS

FIG. 1 is a perspective view of the beverage container carrier in the open configuration, showing a beverage container in an exploded relationship therewith;

FIG. 2 is a side view of the carrier in the closed configuration;

FIG. 3 is a top plan view of the carrier in the open configuration and the panel assemblies in the extended configurations (and, thus, with the body in the compartmentalized configuration);

FIG. 4 is a cross-sectional view as seen along the line 4-4 in FIG. 3;

FIG. 5 is a cross-sectional view as seen along the line 5-5 in FIG. 3;

DETAILED DESCRIPTION OF THE PREFERRED EMBODIMENT

Figure 6:
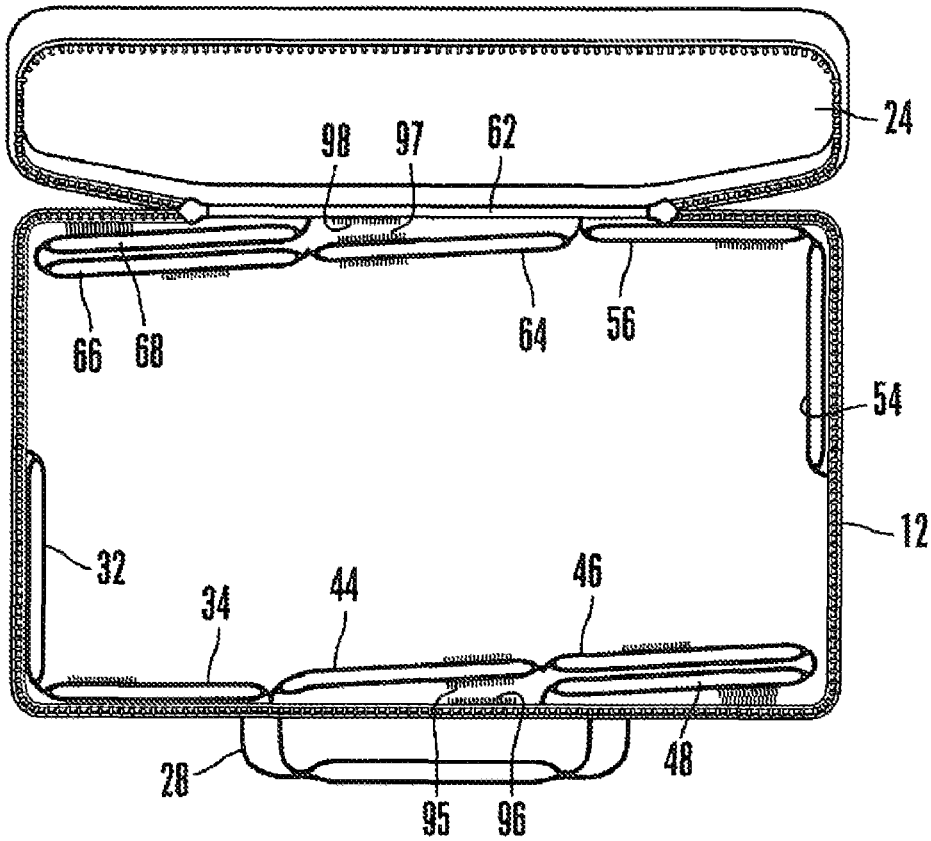
FIG. 6 is a top plan view of the carrier in the open configuration and the panel assemblies in the collapsed configurations (and, thus, with the body in the large configuration)

Referring initially to FIG. 1, a beverage container carrier 10 has a parallelepiped-shaped body 12 defining an internal space 14. A respective beverage container 16 (only a single container 16 shown in FIG. 1 for simplicity) can be in each one of the sub-enclosures described below. The container 16 contains a beverage such as wine that is fit for human consumption.

As perhaps best shown in FIG. 3, the body 12 can be made of inner and outer durable, pliable, preferably waterproof fabric layers 18, 20 between all of which or portions of which may be sandwiched a thermal insulating material 22 such as but not limited to plastic foam, semi-rigid plastic, or both. The fabric layers 18, 20 may be made of nylon, cotton, microfiber, non-woven fabric, polyvinyl chloride, suede or even leather. In one example embodiment the layers 18, 20 are made of denier polyester, product number 210 for the outer layer and product number 200 for the inner. Or, 600×600 denier polyester may be used. The inner layer 18 furthermore may be treated to create a complete water-proof barrier.

Cross-referencing FIGS. 1 and 2, a top 24 can be hingedly connected to the body for movement between an open configuration (FIG. 1), in which the interior space 14 is exposed, and a closed configuration (FIG. 2), in which the interior space 14 is not exposed. In some embodiments the top may be omitted. The top 24 can also be engaged with the body 12 using hook-and-eye fasteners overlapping with the walls of the body. A closure 26 such as a zipper may be provided to hold the top 24 in the closed configuration.

As also shown in FIGS. 1 and 2, opposed handle straps 28 may be attached as by, e.g., sewing to the body 12. The handle straps 28 may be made of 100 polyester and may be, e.g., an inch wide and approximately 32" in length. They can be used to rest on the shoulder like a shoulder strap, or simply carried in the hand. Shorter handles attached to the front and back of the body may alternatively be used as carrying handles only, not shoulder straps. Further, an additional shoulder strap may be attached to either end of the body 12 and can be an adjustable strap. Further still, if desired a padded attachment 30 may be on the handles 28 that makes carrying the bag more comfortable. The shoulder strap likewise may include a padded attachment.

In example embodiments, the width "W" of the body 12 may be fifty percent greater than the depth "D" since six containers are envisioned in non-limiting embodiments to be held in the carrier 10. Thus, for example, the width "W" may be twelve units of length while the depth "D" may be eight units of length.

As shown best in FIG. 3, a first panel assembly is in the interior space 14. Specifically, the first panel assembly includes first and second panels 32, 34 that are joined together along respective edges to establish a first panel hinge 36 as shown. The first panel 32 is vertically (looking down on FIG. 3) attached to, as by sewing, the body 12 along a first wall 38 of the body 12, while the second panel 34 is vertically attached to the body along a second wall 40 of the body that is orthogonal to the first wall 38. With this structure the first panel assembly assumes a collapsed configuration, in which the first panel 32 is substantially flush against the first wall 38 and the second panel 34 is substantially flush against the second wall 40. Also, in the collapsed configuration the first panel hinge 36 is closely juxtaposed with a first corner 42 of the body 12 that is established between the first and second walls 38, 40. The first panel assembly may be moved to an extended configuration, in which the first panel 32 is substantially orthogonal to the first wall 38, the second panel 34 is substantially orthogonal to the second wall 42, and the first panel hinge 36 is distanced from the first corner 42 to establish a first generally parallelepiped-shaped sub-enclosure as shown in FIG. 3.

It is to be understood that while the panel assemblies described herein are sewn to the walls of the body 12, alternatively they may be detachably engaged with the walls by, e.g., hook-and-eye fasteners, so that the panel assemblies may be removed from the body 12 if desired. In this way, for example, the container 10 can be used as a reusable grocery bag. Conversely, the panel assemblies may be unitary with the body by using a single layer of fabric for the body 12 and the panel assemblies. In this way the item could be placed into any existing re-usable grocery bag that users may already own, or be supplied with a group of re-usable grocery bags, thus giving the user options as to what color or style of outer shell or 'body' they would like to use that day.

FIG. 3 also shows that a second panel assembly can be in the space 14. The second panel assembly includes third, fourth, and fifth panels 44, 46, 48, with the third and fourth panels 44, 46 being joined together along respective edges to establish a second panel hinge 50, the fourth and fifth panels 46, 48 being joined together along respective edges to establish a third panel hinge 52, and the third and fifth panels 44, 48 being attached to the body 12 along the second wall 40 of the body. The second panel assembly can be moved between a collapsed configuration, in which the panels of the second panel assembly are substantially flush against the second wall 40, and an extended configuration, in which the third and fifth panels 44, 48 are substantially orthogonal to the second wall 40 and the fourth panel 46 is substantially parallel to and spaced from the second wall 40 to establish a second generally parallelepiped-shaped sub-enclosure as shown.

A third panel assembly may be provided that includes sixth and seventh panels 54, 56 joined together along respective edges to establish a fourth panel hinge 58. The sixth panel 54 is attached to the body along a third wall 60 of the body and the seventh panel 56 is attached to the body along a fourth wall 62 of the body that is orthogonal to the third wall 60. The third panel assembly is movable between a collapsed configuration, in which the sixth panel 54 is substantially flush against the third wall 60, the seventh panel 56 is substantially flush against the fourth wall 62, and the fourth panel hinge 58 is closely juxtaposed with a corner of the body, and an extended configuration, in which the sixth panel 54 is substantially orthogonal to the third wall 60 and the seventh panel 56 is substantially orthogonal to the fourth wall 62 to establish a third generally parallelepiped-shaped sub-enclosure.

In some implementations, some (e.g., the first and third) panel assemblies are biased such that they expand and collapse as a matter of a spring loaded effect and are self-supportive when in both configurations. In other words, owing to, e.g., stiffening filler material in the panels and the cooperation of various hook-and-eye elements described above, one or more panel assemblies may remain biased in whatever configuration the user moves it to until the user applies gentle force to move the assembly into the opposite configuration.

Still further, a fourth panel assembly may be in the space and may include eighth, ninth, and tenth panels 64, 66, 68. The eighth and ninth panels 64, 66 are joined together along respective edges to establish a fifth panel hinge 70, while the ninth and tenth panels 66, 68 are joined together along respective edges to establish a sixth panel hinge 72. The eighth and tenth panels 64, 68 are attached to the body along the fourth wall 62 of the body. The fourth panel assembly is movable between a collapsed configuration, in which the panels of the fourth panel assembly are substantially flush against the fourth wall 62, and an extended configuration, in which the eighth and tenth panels 64, 68 are substantially orthogonal to the fourth wall 62 and the ninth panel 66 is substantially parallel to and spaced from the fourth wall 62 to establish a fourth generally parallelepiped-shaped sub-enclosure. It is to be understood that greater or fewer panel assemblies may be provided as desired to establish greater or fewer than six internal spaces within the carrier.

FIG. 3 also shows that a first hook and eye fastening member can be disposed to hold the second and third panels 34, 44 together when the first and second panel assemblies are in the extended configurations. The hook and eye fastening member may include a hook-bearing substrate 74 on the second panel 34 and an eye-bearing element 76 on the third panel 44.

As well, a second hook and eye fastening member may be disposed to hold the seventh and eighth panels 56, 64 together when the third and fourth panel assemblies are in the extended configurations. The hook and eye fastening member may include a hook-bearing substrate 78 on the seventh panel 56 and an eye-bearing element 80 on the eighth panel 64.

Additionally, in example embodiments a third hook and eye fastening member can be disposed to hold the ninth and fourth panels 66, 46 together when the second and fourth panel assemblies are in the extended configurations. The hook and eye fastening member may include a hook-bearing substrate 82 on the fourth panel 46 and an eye-bearing element 84 on the ninth panel 66.

If desired, a fourth hook and eye fastening member is disposed to hold the fifth panel 48 and second wall 40 together when the second panel assembly is in the collapsed configuration. The hook and eye fastening member may include a hook-bearing substrate 86 on the fifth panel 48 and an eye-bearing element 88 on the wall 40. Similarly, a fifth hook and eye fastening member can be disposed to hold the tenth panel 68 and fourth wall 62 together when the fourth panel assembly is in the collapsed configuration. This hook and eye fastening member may include a hook-bearing substrate 90 on the tenth panel 68 and an eye-bearing element 92 on the wall 62.

Still further and as perhaps best shown in FIG. 6, a sixth hook and eye fastening member can be disposed to hold the third panel 44 and second wall 40 together when the second panel assembly is in the collapsed configuration. This hook and eye fastening member may include a hook-bearing substrate 95 on the third panel 44 and an eye-bearing element 96 on the wall 40. Yet again, a hook-bearing substrate 97 may be on the eighth panel 64 and an eye-bearing element 98 on the fourth wall 62 to hold the fourth panel assembly in the collapsed configuration. The hook and eye elements may be reversed in some or all of the above fastening members.

FIGS. 4 and 5 show that some panels, e.g., the fifth panel 48, may be fabric only without thermally insulative padding while other panels, e.g., the fourth panel 46, may include thermally insulative padding 94 between opposed sheets of the panel. The padding 94 may be, e.g., foam or semi-rigid plastic or both foam and plastic.

In any case, with the above structure for holding the panels both in the collapsed and extended configurations, respectively corresponding to enlarged and compartmentalized configurations of the body 12, the panels cooperate structurally to provide their own support.

It may now be appreciated that the panel assemblies may all be configured at the same time to their collapsed configurations, shown in FIG. 6, to establish a single large void in the interior of the body 12. As more fully disclosed below with reference to FIGS. 10-19, one or more, but not all, panel assemblies may be moved to the collapsed configuration while other panel assemblies are moved to the extended configuration so that fewer than six but greater than one holding void is established within the body 12.

Figure 7:
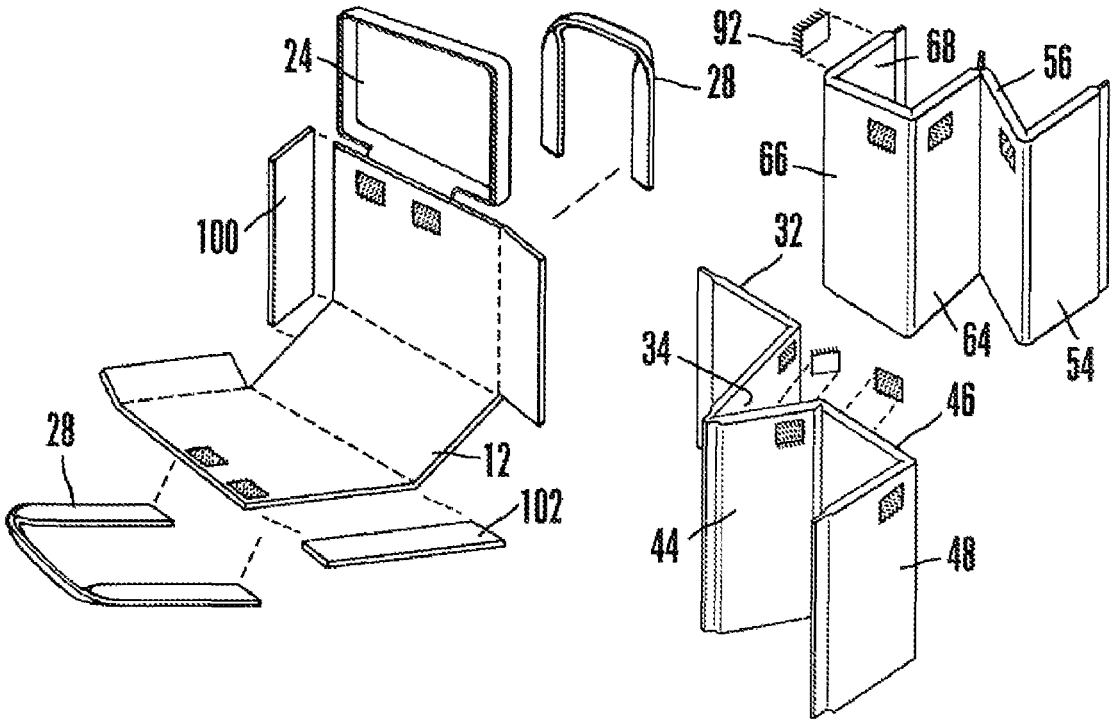
FIG. 7 is an exploded perspective view showing exterior features of the body.

FIG. 7 shows that the body 12 may include an exterior fabric padding. In the example shown in FIG. 7 the body 12 has vertical strips 100, 102 of different colored fabric. Viewing the body from the front, one of the vertical strips covers half of the width on the right, front side and extends from the top to the bottom of the body as shown. A second vertical strip covers half of the width on the left, rear side, and also goes from the top to the bottom.

The purpose for these strips is not only for aesthetics but also so that the two areas of the body covered by the strips can be less protected from an exterior disturbance (such as bumping bag on a car door when getting out of the car) when all of the interior panel assemblies are in the collapsed configuration. In other words, the front and back walls of the body 12 have a 'double protection' when the bag is in a single compartment (large) configuration because the panel assemblies add an additional layer of protection, and the strips 100, 102 afford similar protection to the sides of the body.

Figure 8:
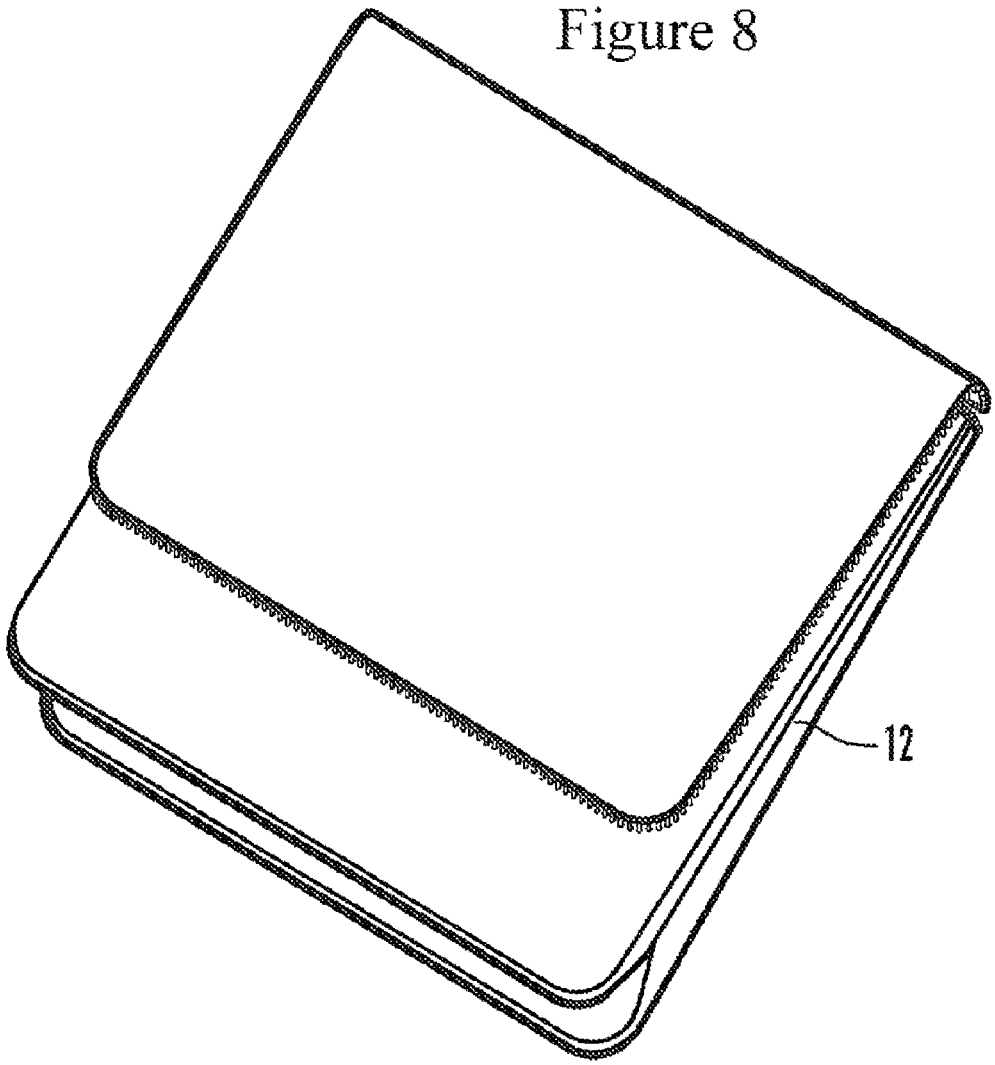
FIGS. 8 and 9 are perspective and side views, respectively, of the body in the folded configuration.
Figure 9:
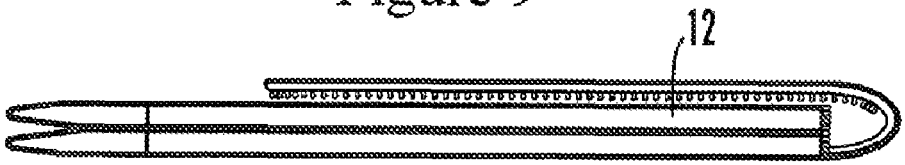
Figure 10:
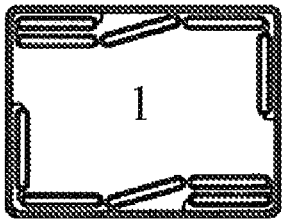
FIGS. 10-19 show the panel assemblies in various combinations of configurations to illustrate the multiple internal space configurations of the carrier, with FIG. 15 in particular showing six compartments labeled "1" through "6", respectively.

FIGS. 8 and 9 show that the flexible material of the body 12 and panel assemblies allows the body 12 to be folded flat for compact storage when not in use.

FIGS. 10-19 further illustrate principles above in which the panel assemblies are individually moved so as to configure the interior of the carrier 10 with one large internal space (FIGS. 6 and 10, with all panel assemblies collapsed), six separate internal spaces (FIGS. 3 and 15, with all panel assemblies extended), or some number of internal spaces therebetween.

Figure 11:
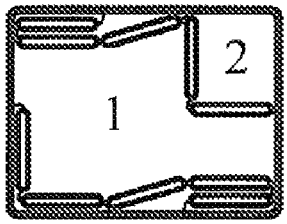
Figure 12:
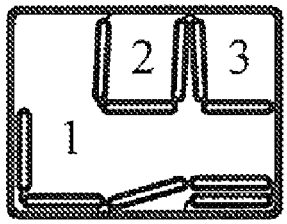
Figure 13:
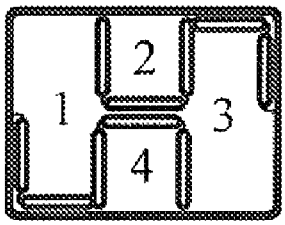
Figure 14:
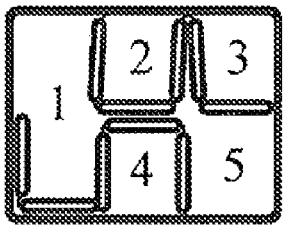
Figure 15:
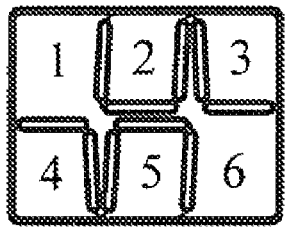

For instance, FIG. 11 shows all but the third panel assembly collapsed such that a large interior sub-space "1" is established in the carrier along with a smaller sub-space "2" in the upper right corner (looking down on FIG. 11) of the carrier. FIG. 12 shows the first and second panel assemblies collapsed and the third and fourth assemblies extended to form a large L-shaped sub-space "1" and two smaller square-shaped sub-spaces "2" and "3". In contrast, FIG. 13 shows the first and third panel assemblies collapsed and the second and fourth assemblies extended to form opposed vertically (looking down on FIG. 13) elongated sub-spaces "1" and "3" straddling two smaller square-shaped sub-spaces "2" and "4", while FIG. 14 shows all but the first panel assembly extended to form a single elongated sub-space "1" along the left side of the carrier and four square sub-spaces "2"-"5" arranged in a larger square.

Figure 16:
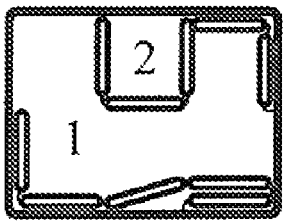
Figure 17:
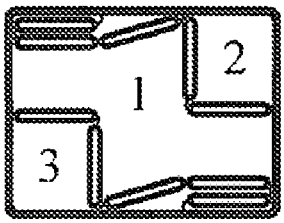
Figure 18:
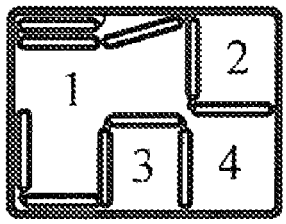
Figure 19:
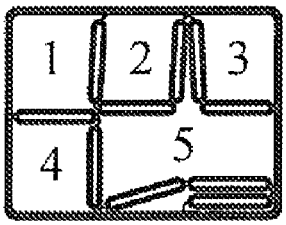

FIG. 16 shows that only the fourth panel assembly need be extended to form a large U-shaped sub-space "1" and a small square-shaped sub-space "2" along the fourth wall of the carrier. FIG. 17 shows that the first and third panel assemblies may be extended while the other assemblies remain collapsed to form a Z-shaped sub-space "1" with square-shaped sub-spaces "2" and "3" being formed at the upper right and lower left, respectively, of the carrier. FIG. 18 shows that the second and third panel assemblies may be extended and the others collapsed to form a right angle-shaped sub-space "1" and three square-shaped sub-spaces "2"-"4" as shown. In this configuration, additional hook-and-eye fastening members may be provided on adjacent corners of the second and third assemblies to hold the corners together. Similarly, if desired additional fastening members may be provided on corners of the first and fourth assemblies that contact each other when these assemblies are extended to hold them together. Lastly, FIG. 19 shows that all but the second panel assembly may be extended to form a horizontally elongated (looking down on FIG. 19) sub-space "5" and four square sub-spaces "1"-"4" as shown.

It may now be appreciated that with the variety of internal space configurations described above, the carrier 10 may be used to hold up to six bottles of wine securely, as well as to hold less than six bottles of wine along with other items, e.g., grocery items, with all items being held in a separate and safe way.

While the particular VERSATILE MULTI-COMPARTMENT BEVERAGE CONTAINER CARRIER is herein shown and described in detail, it is to be understood that the subject matter which is encompassed by the present invention is limited only by the claims.

What is claimed is:

1. A carrier comprising:

a parallelepiped-shaped body defining an internal space;

a first panel assembly in the space, the first panel assembly including first and second panels joined together along respective edges to establish a first panel hinge, the first panel being attached to the body along a first wall of the body, the second panel being attached to the body along a second wall of the body orthogonal to the first wall, the first panel assembly being movable between a collapsed configuration, in which the first panel is substantially flush against the first wall, the second panel is substantially flush against the second wall, and the first panel hinge is closely juxtaposed with a first corner of the body established between the first and second walls, and an extended configuration, in which the first panel is substantially orthogonal to the first wall, the second panel is substantially orthogonal to the second wall, and the first panel hinge is distanced from the first corner to establish a first generally parallelepiped-shaped sub-enclosure;

a second panel assembly in the space, the second panel assembly including third, fourth, and fifth panels, the third and fourth panels being joined together along respective edges to establish a second panel hinge, the fourth and fifth panels being joined together along respective edges to establish a third panel hinge, the third and fifth panels being attached to the body along the second wall of the body, the second panel assembly being movable between a collapsed configuration, in which the panels of the second panel assembly are substantially flush against the second wall, and an extended configuration, in which the third and fifth panels are substantially orthogonal to the second wall and the fourth panel is substantially parallel to and spaced from the second wall to establish a second generally parallelepiped-shaped sub-enclosure;

a third panel assembly in the space, the third panel assembly including sixth and seventh panels joined together along respective edges to establish a fourth panel hinge, the sixth panel being attached to the body along a third wall of the body, the seventh panel being attached to the body along a fourth wall of the body orthogonal to the third wall, the third panel assembly being movable between a collapsed configuration, in which the sixth panel is substantially flush against the third wall, the seventh panel is substantially flush against the fourth wall, and the fourth panel hinge is closely juxtaposed with a corner of the body, and an extended configuration, in which the sixth panel is substantially orthogonal to the third wall and the seventh panel is substantially orthogonal to the fourth wall to establish a third generally parallelepiped-shaped sub-enclosure;

a fourth panel assembly in the space, the fourth panel assembly including eighth, ninth, and tenth panels, the eighth and ninth panels being joined together along respective edges to establish a fifth panel hinge, the ninth and tenth panels being joined together along respective edges to establish a sixth panel hinge, the eighth and tenth panels being attached to the body along a fourth wall of the body, the fourth panel assembly being movable between a collapsed configuration, in which the panels of the fourth panel assembly are substantially flush against the fourth wall, and an extended configuration, in which the eighth and tenth panels are substantially orthogonal to the fourth wall and the ninth panel is substantially parallel to and spaced from the fourth wall to establish a fourth generally parallelepiped-shaped sub-enclosure;

a first hook and eye fastening member disposed to hold the second and third panels together when the first and second panel assemblies are in the extended configurations;

a second hook and eye fastening member disposed to hold the seventh and eighth panels together when the third and fourth panel assemblies are in the extended configurations; and a third hook and eye fastening member disposed to hold the ninth and fourth panels together when the second and fourth panel assemblies are in the extended configurations.

2. The carrier of claim 1, comprising a fourth hook and eye fastening member disposed to hold the fifth panel and second wall together when the second panel assembly is in the collapsed configuration.

3. The carrier of claim 2, comprising a fifth hook and eye fastening member disposed to hold the tenth panel and fourth wall together when the fourth panel assembly is in the collapsed configuration.

4. The carrier of claim 1, comprising at least one beverage container in a sub-enclosure, the beverage container holding a liquid suitable for human consumption.

5. The carrier of claim 1, comprising a top member hingedly attached to the body to removably cover the internal space.

6. The carrier of claim 5, comprising a handle member attached to the body and configured for grasping by a person.

7. The carrier of claim 1, wherein at least one panel is reinforced with an internal filler pad and at least one panel is not reinforced with an internal filler pad.

8. A beverage container carrier comprising:

a parallelepiped-shaped insulated body defining an internal space;

plural panels in the space, each panel being movable along an edge thereof and at least some panels being sewn to the body along respective edges about what which the respective panels can pivot from a large configuration, in which all panels are substantially flat against an adjacent side of the body or against another panel that is flat against an adjacent side of the body, the panels being movable to a compartmentalized configuration, wherein two panels in cooperation with a side of the body establish a respective rectangular space configured for holding a respective container, wherein two panels can be held together along respective internal edges using a hook and eye fastening structure, with the panels cooperating structurally to provide their own support, wherein at least one panel is reinforced with an internal filler pad and at least another panel is not reinforced with an internal filler pad, and further comprising:

a first panel assembly in the space, the first panel assembly including first and second panels joined together along respective edges to establish a first panel hinge, the first panel being sewn to the body along a first wall of the body, the second panel being sewn to the body along a second wall of the body orthogonal to the first wall, the first panel assembly being movable between a collapsed configuration, in which the first panel is substantially flush against the first wall, the second panel is substantially flush against the second wall and the first panel hinge is closely juxtaposed with a first corner of the body established between the first and second walls and an extended configuration, in which the first panel is substantially orthogonal to the first wall, the second panel is substantially orthogonal to the second wall, and the first panel hinge is distanced from the first corner to establish a first generally parallelepiped-shaped sub-enclosure.

9. The carrier of claim 8, comprising:

a second panel assembly in the space, the second panel assembly including third, fourth, and fifth panels, the third and fourth panels being joined together along respective edges to establish a second panel hinge, the fourth and fifth panels being joined together along respective edges to establish a third panel hinge, the third and fifth panels being sewn to the body along the second wall of the body, the second panel assembly being movable between a collapsed configuration, in which the panels of the second panel assembly are substantially flush against the second wall, and an extended configuration, in which the third and fifth panels are substantially orthogonal to the second wall and the fourth panel is substantially parallel to and spaced from the second wall to establish a second generally parallelepiped-shaped sub-enclosure.

10. The carrier of claim 9, comprising:

a third panel assembly in the space, the third panel assembly including sixth and seventh panels joined together along respective edges to establish a fourth panel hinge, the sixth panel being sewn to the body along a third wall of the body, the seventh panel being sewn to the body along a fourth wall of the body orthogonal to the third wall, the third panel assembly being movable between a collapsed configuration, in which the sixth panel is substantially flush against the third wall, the seventh panel is substantially flush against the fourth wall, and the fourth panel hinge is closely juxtaposed with a corner of the body, and an extended configuration, in which the sixth panel is substantially orthogonal to the third wall and the seventh panel is substantially orthogonal to the fourth wall to establish a third generally parallelepiped-shaped sub-enclosure.

11. The carrier of claim 10, comprising:

a fourth panel assembly in the space, the fourth panel assembly including eighth, ninth, and tenth panels, the eighth and ninth panels being joined together along respective edges to establish a fifth panel hinge, the ninth and tenth panels being joined together along respective edges to establish a sixth panel hinge, the eighth and tenth panels being sewn to the body along a fourth wall of the body, the fourth panel assembly being movable between a collapsed configuration, in which the panels of the fourth panel assembly are substantially flush against the fourth wall, and an extended configuration, in which the eighth and tenth panels are substantially orthogonal to the fourth wall and the ninth panel is substantially parallel to and spaced from the fourth wall to establish a fourth generally parallelepiped-shaped sub-enclosure.

12. The carrier of claim 11, comprising:

a first hook and eye fastening member disposed to hold the second and third panels together when the first and second panel assemblies are in the extended configurations.

13. The carrier of claim 12, comprising:

a second hook and eye fastening member disposed to hold the seventh and eighth panels together when the third and fourth panel assemblies are in the extended configurations.

14. The carrier of claim 13, comprising:

a third hook and eye fastening member disposed to hold the ninth and fourth panels together when the second and fourth panel assemblies are in the extended configurations.

15. The carrier of claim 14, comprising a fourth hook and eye fastening member disposed to hold the fifth panel and second wall together when the second panel assembly is in the collapsed configuration and a fifth hook and eye fastening member disposed to hold the tenth panel and fourth wall together when the fourth panel assembly is in the collapsed configuration.

16. A beverage container carrier comprising:

parallelepiped-shaped insulated body with an internal space;

the internal space being variously configurable by orienting internal panels, some of which are sewn along one side to the body, to form rectangular spaces for holding respective containers;

at least two panels being detachably held together along respective internal edges using a hook-and-eye fastener with the panels cooperating structurally to provide their own support a first panel assembly in the space, the first panel assembly including first and second panels joined together along respective edges to establish a first panel hinge, the first panel being sewn to the body along a first wall of the body, the second panel being sewn to the body along a second wall of the body orthogonal to the first wall, the first panel assembly being movable between a collapsed configuration, in which the first panel is substantially flush against the first wall, the second panel is substantially flush against the second wall, and the first panel hinge is closely juxtaposed with a first corner of the body established between the first and second walls, and an extended configuration, in which the first panel is substantially orthogonal to the first wall, the second panel is substantially orthogonal to the second wall, and the first panel hinge is distanced from the first corner to establish a first generally parallelepiped-shaped sub-enclosure;

a second panel assembly in the space, the second panel assembly including third, fourth, and fifth panels, the third and fourth panels being joined together along respective edges to establish a second panel hinge, the fourth and fifth panels being joined together along respective edges to establish a third panel hinge, the third and fifth panels being sewn to the body along the second wall of the body, the second panel assembly being movable between a collapsed configuration, in which the panels of the second panel assembly are substantially flush against the second wall, and an extended configuration, in which the third and fifth panels are substantially orthogonal to the second wall and the fourth panel is substantially parallel to and spaced from the second wall to establish a second generally parallelepiped-shaped sub-enclosure;

a third panel assembly in the space, the third panel assembly including sixth and seventh panels joined together along respective edges to establish a fourth panel hinge, the sixth panel being sewn to the body along a third wall of the body, the seventh panel being sewn to the body along a fourth wall of the body orthogonal to the third wall, the third panel assembly being movable between a collapsed configuration, in which the sixth panel is substantially flush against the third wall, the seventh panel is substantially flush against the fourth wall, and the fourth panel hinge is closely juxtaposed with a corner of the body, and an extended configuration, in which the sixth panel is substantially orthogonal to the third wall and the seventh panel is substantially orthogonal to the fourth wall to establish a third generally parallelepiped-shaped sub-enclosure; and a fourth panel assembly in the space, the fourth panel assembly including eighth, ninth, and tenth panels, the eighth and ninth panels being joined together along respective edges to establish a fifth panel hinge, the ninth and tenth panels being joined together along respective edges to establish a sixth panel hinge, the eighth and tenth panels being sewn to the body along a fourth wall of the body the fourth panel assembly being movable between a collapsed configuration, in which the panels of the fourth panel assembly are substantially flush against the fourth wall and an extended configuration, in which the eighth and tenth panels are substantially orthogonal to the fourth wall and the ninth panel is substantially parallel to and spaced from the fourth wall to establish a fourth generally parallelepiped-shaped sub-enclosure.

17. The beverage container carrier of claim 16, comprising:

a first hook and eye fastening member disposed to hold the second and third panels together when the first and second panel assemblies are in the extended configurations;

a second hook and eye fastening member disposed to hold the seventh and eighth panels together when the third and fourth panel assemblies are in the extended configurations; and a third hook and eye fastening member disposed to hold the ninth and fourth panels together when the second and fourth panel assemblies are in the extended configurations.

* * * * *